US007954571B2

(12) United States Patent
McClain et al.

(10) Patent No.: US 7,954,571 B2
(45) Date of Patent: Jun. 7, 2011

(54) CUTTING STRUCTURES FOR CASING COMPONENT DRILLOUT AND EARTH-BORING DRILL BITS INCLUDING SAME

(75) Inventors: Eric E. McClain, Spring, TX (US); Michael L. Doster, Spring, TX (US); John C. Thomas, Lafayette, LA (US); Matthew R. Isbell, Houston, TX (US); Jarod DeGeorge, Houston, TX (US); Chad T. Jurica, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 142 days.

(21) Appl. No.: 12/030,110

(22) Filed: Feb. 12, 2008

(65) Prior Publication Data

US 2009/0084608 A1 Apr. 2, 2009

Related U.S. Application Data

(60) Provisional application No. 60/976,968, filed on Oct. 2, 2007.

(51) Int. Cl.
*E21B 10/43* (2006.01)

(52) U.S. Cl. ..... 175/431

(58) Field of Classification Search ..... 175/425, 175/431, 57

See application file for complete search history.

(56) References Cited

U.S. PATENT DOCUMENTS

| | | | | |
|---|---|---|---|---|
| 1,342,424 A | | 6/1920 | Cotten | |
| 1,981,525 A | | 11/1934 | Price | |
| 1,997,312 A | | 4/1935 | Satre | |
| 2,215,913 A | | 9/1940 | Brown | |
| 2,334,788 A | | 11/1943 | O'Leary | |
| 2,869,825 A | | 1/1959 | Crawford | |
| 2,940,731 A | | 6/1960 | Poole | |
| 3,127,945 A | * | 4/1964 | Bridwell et al. | 175/434 |
| 3,258,817 A | * | 7/1966 | Smiley | 164/496 |
| 3,266,577 A | | 8/1966 | Turner | |
| 3,565,192 A | | 2/1971 | McLarty | |
| 3,624,760 A | | 11/1971 | Bodine | |
| 3,997,009 A | | 12/1976 | Fox | |

(Continued)

FOREIGN PATENT DOCUMENTS

CA 1222448 6/1987

(Continued)

OTHER PUBLICATIONS

Random House and Collins English Dictionary's definition of "abrasive", accessed Oct. 28, 2010 at http://dictionary.reference.com.*

(Continued)

*Primary Examiner* — Shane Bomar
*Assistant Examiner* — Blake Michener
(74) *Attorney, Agent, or Firm* — TraskBritt

(57) ABSTRACT

A drill bit includes a bit body having a face on which two different types of cutters are disposed, the first type being cutting elements suitable for drilling at least one subterranean formation and the second type being at least one of an abrasive cutting structure and an abrasive cutting element suitable for drilling through a casing shoe, reamer shoe, casing bit, casing or liner string and cementing equipment or other components, as well as cement. Methods of forming earth-boring tools are also disclosed.

27 Claims, 7 Drawing Sheets

U.S. PATENT DOCUMENTS 4,190,383 A 2/1980 Pryke et al.
4,255,165 A 3/1981 Dennis et al.
4,351,401 A 9/1982 Fielder
4,413,682 A 11/1983 Callihan et al.
4,618,010 A 10/1986 Falgout, Sr. et al.
4,624,316 A 11/1986 Baldridge et al.
4,673,044 A 6/1987 Bigelow et al.
4,682,663 A 7/1987 Daly et al.
4,759,413 A 7/1988 Bailey et al.
4,782,903 A 11/1988 Strange
4,842,081 A 6/1989 Parant
4,956,238 A 9/1990 Griffin
5,025,874 A 6/1991 Barr et al.
5,027,912 A 7/1991 Juergens
5,127,482 A 7/1992 Rector, Jr.
5,135,061 A 8/1992 Newton, Jr.
5,168,941 A 12/1992 Krueger et al.
5,186,265 A 2/1993 Henson et al.
5,259,469 A 11/1993 Stjernstrom et al.
5,271,472 A 12/1993 Leturno
5,285,204 A 2/1994 Sas-Jaworsky
5,289,889 A 3/1994 Gearhart et al.
5,311,954 A 5/1994 Quintana
5,314,033 A 5/1994 Tibbitts
5,322,139 A 6/1994 Rose et al.
5,341,888 A 8/1994 Deschutter
5,379,835 A 1/1995 Streich
5,402,856 A 4/1995 Warren et al.
5,423,387 A 6/1995 Lynde
5,443,565 A 8/1995 Strange, Jr.
5,450,903 A 9/1995 Budde
5,497,842 A 3/1996 Pastusek et al.
5,531,281 A 7/1996 Murdock
5,533,582 A 7/1996 Tibbitts
5,605,198 A 2/1997 Tibbitts et al.
5,706,906 A 1/1998 Jurewicz et al.
5,720,357 A 2/1998 Fuller et al.
5,765,653 A 6/1998 Doster et al.
5,787,022 A 7/1998 Tibbitts et al.
5,842,517 A 12/1998 Coone
5,887,655 A 3/1999 Haugen et al.
5,887,668 A * 3/1999 Haugen et al. ..... 175/79
5,950,747 A 9/1999 Tibbitts et al.
5,957,225 A 9/1999 Sinor
5,960,881 A 10/1999 Allamon et al.
5,979,571 A 11/1999 Scott et al.
5,992,547 A 11/1999 Caraway et al.
6,009,962 A 1/2000 Beaton
6,021,859 A 2/2000 Tibbitts et al.
6,050,354 A 4/2000 Pessier et al.
6,062,326 A 5/2000 Strong et al.
6,063,502 A 5/2000 Sue et al.
6,065,554 A 5/2000 Taylor et al.
6,073,518 A 6/2000 Chow et al.
6,098,730 A 8/2000 Scott et al.
6,131,675 A 10/2000 Anderson
6,298,930 B1 10/2001 Sinor et al.
6,360,831 B1 3/2002 Akesson et al.
6,401,820 B1 6/2002 Kirk et al.
6,408,958 B1 6/2002 Isbell et al.
6,412,579 B2 7/2002 Fielder
6,415,877 B1 7/2002 Fincher et al.
6,439,326 B1 8/2002 Huang et al.
6,443,247 B1 9/2002 Wardley
6,460,631 B2 10/2002 Dykstra et al.
6,497,291 B1 12/2002 Szarka
6,510,906 B1 1/2003 Richert et al.
6,513,606 B1 2/2003 Krueger
6,540,033 B1 4/2003 Sullivan et al.
6,543,312 B2 4/2003 Sullivan et al.
6,568,492 B2 5/2003 Thigpen et al.
6,571,886 B1 6/2003 Sullivan et al.
6,606,923 B2 8/2003 Watson et al.
6,612,383 B2 9/2003 Desai et al.
6,620,308 B2 9/2003 Gilbert
6,620,380 B2 9/2003 Thomas et al.
6,622,803 B2 9/2003 Harvey et al.
6,626,251 B1 9/2003 Sullivan et al.
6,648,081 B2 11/2003 Fincher et al.
6,651,756 B1 * 11/2003 Casto, Jr. et al. ..... 175/374
6,655,481 B2 12/2003 Findley et al.
6,659,173 B2 12/2003 Kirk et al.
6,672,406 B2 1/2004 Beuershausen
6,702,040 B1 3/2004 Sensenig
6,702,045 B1 3/2004 Elsby
6,708,769 B2 3/2004 Haugen et al.
6,747,570 B2 6/2004 Beique et al.
6,779,613 B2 8/2004 Dykstra et al.
6,779,951 B1 8/2004 Vale et al.
6,817,633 B2 11/2004 Brill et al.
6,848,517 B2 2/2005 Wardley
6,857,487 B2 2/2005 Galloway et al.
6,983,811 B2 1/2006 Wardley
7,025,156 B1 * 4/2006 Caraway ..... 175/426
7,036,611 B2 5/2006 Radford et al.
7,044,241 B2 5/2006 Angman
7,066,253 B2 6/2006 Baker
7,096,982 B2 8/2006 McKay et al.
7,117,960 B2 10/2006 Wheeler et al.
7,137,460 B2 11/2006 Slaughter et al.
7,178,609 B2 2/2007 Hart et al.
7,204,309 B2 4/2007 Segura et al.
7,216,727 B2 5/2007 Wardley
7,360,608 B2 * 4/2008 Brackin et al. ..... 175/57
7,367,410 B2 5/2008 Sangesland
2002/0121393 A1 * 9/2002 Thigpen et al. ..... 175/431
2004/0216926 A1 11/2004 Dykstra et al.
2004/0245020 A1 12/2004 Giroux et al.
2005/0145417 A1 7/2005 Radford et al.
2005/0152749 A1 7/2005 Anres et al.
2005/0183892 A1 8/2005 Oldham et al.
2006/0070771 A1 * 4/2006 McClain et al. ..... 175/57
2007/0079995 A1 4/2007 McClain et al.
2008/0308321 A1 * 12/2008 Aliko et al. ..... 175/431

FOREIGN PATENT DOCUMENTS

CA 2411856 A1 12/2001
DE 4432710 C1 4/1996
EP 0028121 A1 5/1981
EP 0916803 A 5/1999
EP 1006260 B1 4/2004
GB 2086451 A 5/1982
GB 2170528 A 8/1986
GB 2345503 A 7/2000
GB 2351987 A 1/2001
GB 2359572 A 8/2001
GB 2396870 A 7/2004
WO 9325794 A1 12/1993
WO 9628635 A1 9/1996
WO 9813572 A1 4/1998
WO 9936215 A1 7/1999
WO 9937881 A1 7/1999
WO 0050730 A1 8/2000
WO 0142617 A1 6/2001
WO 0146550 A1 6/2001
WO 0194738 A1 12/2001
WO 0246564 A1 6/2002
WO 03087525 A1 10/2003
WO 2004076800 A1 9/2004
WO 2004097168 A1 11/2004
WO 2005071210 A1 8/2005
WO 2005083226 A1 9/2005
WO 2007038208 A 4/2007

OTHER PUBLICATIONS

International Search Report, dated Jul. 15, 2005 (6 pages).

Greg Galloway Weatherford International, "Rotary Drilling with Casing—A Field Proven Method of Reducing Wellbore Construction Cost," World Oil Casing Drilling Technical Conference, Mar. 6-7, 2003, pp. 1-7.

McKay et al, New Developments in the Technology of Drilling with Casing: Utilizing a Displaceable DrillShoe Tool, World Oil Casing Drilling Technical Conference, Mar. 6-7, 2003, pp. 1-11.

PCT International Search Report for PCT Application No. PCT/US2006/036855, mailed Feb. 1, 2007.

Baker Oil Tools Drill Down Float Shoes, 6 pages, various dates prior to May 23, 1997.
Caledus BridgeBUSTER Product Information Sheet, 3 pages, 2004.
Downhole Products plc, Davis-Lynch, Inc. Pen-o-trator, 2 pages, no date indicated.
Ray Oil Tool, The Silver Bullet Float Shoes & Collars, 2 pages, no date indicated.
Weatherford Cementation Products, BBL Reamer Shoes, 4 pages, 1998.
PCT International Search Report for PCT Application No. PCT/US2007/011543, mailed Nov. 19, 2007.
PCT International Search Report, mailed Feb. 2, 2009, for International Application No. PCT/US2008/066300.
International Search Report for International Application No. PCT/US2008/078414 mailed Jul. 5, 2009, 5 pages.
International Written Opinion for International Application No. PCT/US2008/078414 mailed Jul. 5, 2009, 6 pages.

* cited by examiner

CUTTING STRUCTURES FOR CASING COMPONENT DRILLOUT AND EARTH-BORING DRILL BITS INCLUDING SAME

CROSS-REFERENCE TO RELATED APPLICATION

The present application claims the benefit of U.S. Provisional Patent Application Ser. No. 60/976,968, filed Oct. 2, 2007, the disclosure of which is incorporated herein by reference in its entirety. This application is related to U.S. patent application Ser. No. 12/129,308, filed. May 29, 2008, pending, which is a divisional of U.S. patent application Ser. No. 10/783,720, filed Feb. 19, 2004, now U.S. Pat. No. 7,395,882, issued Jul. 8, 2008; U.S. patent application Ser. No. 11/928,956, filed Oct. 30, 2007, now U.S. Pat. No. 7,748,475, issued Jul. 6, 2010 which is a continuation of U.S. patent application Ser. No. 11/234,076, filed Sep. 23, 2005, now U.S. Pat. NO. 7,624,818, issued Dec. 1, 2009; U.S. patent application Ser. No. 12/624,311, filed Nov. 23, 2009 which is a divisional of U.S. application Ser. No. 11/747.651, filed. May 11, 2007, now U.S. Pat. No. 7,621,351, issued Nov. 24, 2009, pending, which claims the benefit of U.S. Provisional Patent Application Ser. No. 60/800,621, U.S. patent application Ser. No. 11/524,503, filed. Sep. 20, 2006, pending; U.S. patent application. Ser. No. 11/764,008, filed Jun. 15, 2007, now U.S. Pat. No. 7,836,978, issued Nov. 23, 2010; U.S. patent application Ser. No. 10/916,342, filed Aug. 10, 2004, now U.S. Pat. No. 7,178,609, issued Feb. 20, 2007; and U.S. patent application Ser. No. 11/166,471, filed Jun. 24, 2005, now U.S. Pat. No. 7,757,784 issued Jul. 20, 2010.

TECHNICAL FIELD

Embodiments of the present invention relate generally to drilling a subterranean borehole. More specifically, some embodiments relate to drill bits and tools for drilling subterranean formations and having a capability for drilling out structures and materials which may be located at, or proximate to, the end of a casing or liner string, such as a casing bit or shoe, cementing equipment components and cement before drilling a subterranean formation. Other embodiments relate to drill bits and tools for drilling through the sidewall of a casing or liner string and surrounding cement before drilling an adjacent formation.

BACKGROUND

Drilling wells for oil and gas production conventionally employs longitudinally extending sections, or so-called "strings," of drill pipe to which, at one end, is secured a drill bit of a larger diameter. After a selected portion of the borehole has been drilled, a string of tubular members of lesser diameter than the borehole, known as casing, is placed in the borehole. Subsequently, the annulus between the wall of the borehole and the outside of the casing is filled with cement. Therefore, drilling and casing according to the conventional process typically requires sequentially drilling the borehole using drill string with a drill bit attached thereto, removing the drill string and drill bit from the borehole, and disposing and cementing a casing into the borehole. Further, often after a section of the borehole is lined with casing and cemented, additional drilling beyond the end of the casing or through a sidewall of the casing may be desired. In some instances, a string of smaller tubular members, known as a liner string, is run and cemented within previously run casing. As used herein, the term "casing" includes tubular members in the form of liners.

Because sequential drilling and running a casing or liner string may be time consuming and costly, some approaches have been developed to increase efficiency, including the use of reamer shoes disposed on the end of a casing string and drilling with the casing itself. Reamer shoes employ cutting elements on the leading end that can drill through modest obstructions and irregularities within a borehole that has been previously drilled, facilitating running of a casing string and ensuring adequate well bore diameter for subsequent cementing. Reamer shoes also include an end section manufactured from a material that is readily drillable by drill bits. Accordingly, when cemented into place, reamer shoes usually pose no difficulty to a subsequent drill bit to drill through. For instance, U.S. Pat. No. 6,062,326 to Strong et al. discloses a casing shoe or reamer shoe in which the central portion thereof may be configured to be drilled through. However, the use of reamer shoes requires the retrieval of the drill bit and drill string used to drill the borehole before the casing string with the reamer shoe is run into the borehole.

Drilling with casing is effected using a specially designed drill bit, termed a "casing bit," attached to the end of the casing string. The casing bit functions not only to drill the earth formation, but also to guide the casing into the borehole. The casing string is, thus, run into the borehole as it is drilled by the casing bit, eliminating the necessity of retrieving a drill string and drill bit after reaching a target depth where cementing is desired. While this approach greatly increases the efficiency of the drilling procedure, further drilling to a greater depth must pass through or around the casing bit attached to the end of the casing string.

In the case of a casing shoe, reamer shoe or casing bit that is drillable, further drilling may be accomplished with a smaller diameter drill bit and casing string attached thereto that passes through the interior of the first casing string to drill the further section of the borehole beyond the previously attained depth. Of course, cementing and further drilling may be repeated as necessary, with correspondingly smaller and smaller tubular components, until the desired depth of the wellbore is achieved.

However, where a conventional drill bit is employed and it is desired to leave the bit in the well bore, further drilling may be difficult, as conventional drill bits are required to remove rock from formations and, accordingly, often include very drilling-resistant, robust structures typically manufactured from materials such as tungsten carbide, polycrystalline diamond, or steel. Attempting to drill through a conventional drill bit affixed to the end of a casing may result in damage to the subsequent drill bit and bottom-hole assembly deployed. It may be possible to drill through casing above a conventional drill bit with special tools known as mills, but these tools are generally unable to penetrate rock formations effectively to any great distance and, so, would have to be retrieved or "tripped" from the borehole and replaced with a drill bit. In this case, the time and expense saved by drilling with casing would have been lost.

To enable effective drilling of casing and casing-associated components manufactured from robust, relatively inexpensive and drillable iron-based materials such as, for example, high-strength alloy steels, which are generally non-drillable by diamond cutting elements as well as subsequent drilling through the adjacent formation, it would be desirable to have a drill bit or tool offering the capability of drilling through such casing or casing-associated components, while at the same time offering the subterranean drilling capabilities of a conventional drill bit or tool employing superabrasive cutting elements.

BRIEF SUMMARY

Various embodiments of the present invention are directed toward an earth-boring tool for drilling through casing components and associated material. In one embodiment, an earth-boring tool of the present invention may comprise a body having a face at a leading end thereof. The face may comprise a plurality of generally radially extending blades. A plurality of cutting elements may be disposed on the plurality of blades over the body. At least one elongated abrasive cutting structure may be disposed over the body and may extend radially outward along at least one of the plurality of blades in association with at least some of the plurality of cutting elements. The at least one elongated abrasive cutting structure may have a greater relative exposure than the plurality of cutting elements.

In other embodiments, an earth-boring tool may comprise a body having a face at a leading end thereof, and a plurality of generally radially extending blades over the face. A plurality of cutting elements may be disposed on the plurality of blades. A plurality of abrasive cutting structures may be disposed over at least one of the plurality of blades in association with at least some of the plurality of cutting elements. The plurality of abrasive cutting structures may have a greater relative exposure than the plurality of cutting elements, and the plurality of abrasive cutting structures may comprise a composite material comprising a plurality of carbide particles in a matrix material. The plurality of carbide particles may comprise substantially rough or sharp edges.

Other embodiments of the present invention comprise methods of forming an earth-boring tool. The method may comprise forming a bit body comprising a face at a leading end thereof. The face may comprise a plurality of generally radially extending blades thereon. A plurality of cutting elements may be disposed on the plurality of blades. At least one abrasive cutting structure may be disposed on at least one of the plurality of blades in association with at least one of the plurality of cutting elements. The at least one abrasive cutting structure may comprise a composite material comprising a plurality of hard particles with substantially rough surfaces in a matrix material.

DETAILED DESCRIPTION

Figure 1:
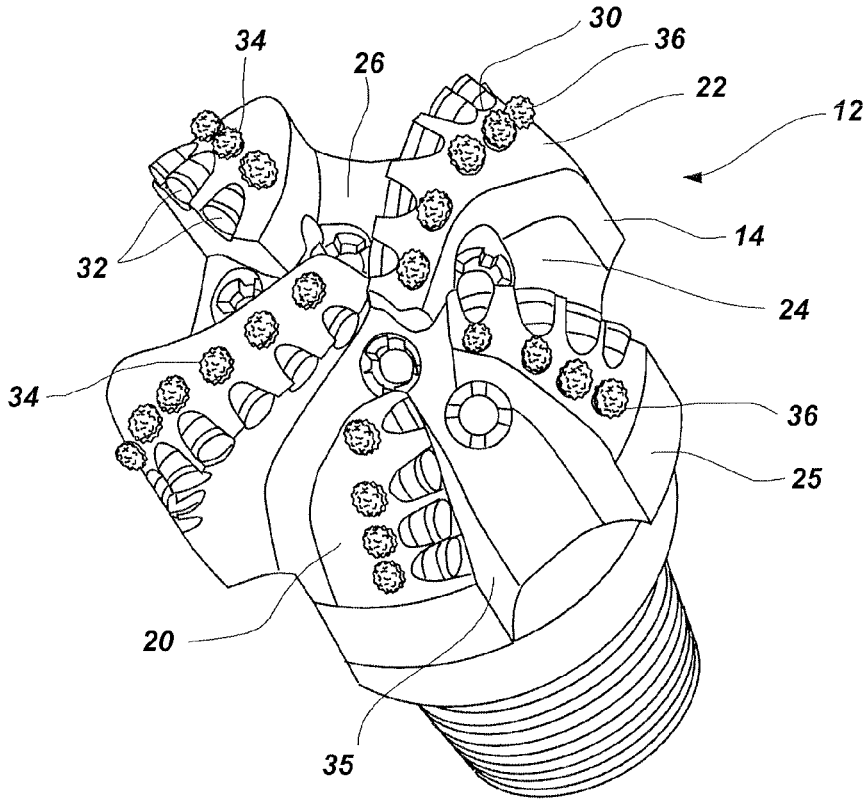
FIG. 1 shows a perspective view of an embodiment of a drill bit of the present invention.

The illustrations presented herein are, in some instances, not actual views of any particular cutting element, cutting stricture, or drill bit, but are merely idealized representations, which are employed to describe the present invention. Additionally, elements common between figures may retain the same numerical designation.

FIGS. 1-5 illustrate several variations of an embodiment of a drill bit 12 in the form of a fixed-cutter or so-called "drag" bit, according to the present invention. For the sake of clarity, like numerals have been used to identify like features in FIGS. 1-5. As shown in FIGS. 1-5, drill bit 12 includes a body 14 having a face 26 and generally radially extending blades 22, forming fluid courses 24 therebetween extending to junk slots 35 between circumferentially adjacent blades 22. Body 14 may comprise a tungsten carbide matrix or a steel body, both are well-known in the art. Blades 22 may also include pockets 30, which may be configured to receive cutting elements of one type such as, for instance, superabrasive cutting elements in the form of polycrystalline diamond compact (PDC) cutting elements 32. Generally, such a PDC cutting element may comprise a superabrasive (diamond) mass that is bonded to a substrate. Rotary drag bits employing PDC cutting elements have been employed for several decades. PDC cutting elements are typically comprised of a disc-shaped diamond "table" formed on and bonded under an ultra high-pressure and high-temperature (HPHT) process to a supporting substrate formed of cemented tungsten carbide (WC), although other configurations are known. Drill bits carrying PDC cutting elements, which, for example, may be brazed into pockets in the bit face, pockets in blades extending from the face, or mounted to studs inserted into the bit body, are known in the art. Thus, PDC cutting elements 32 may be affixed upon the blades 22 of drill bit 12 by way of brazing, welding, or as otherwise known in the art. If PDC cutting elements 32 are employed, they maybe back raked at a common angle, or at varying angles. By way of non-limiting example, PDC cutting elements 32 may be back raked at 15° within the cone of the bit face proximate the centerline of the bit, at 20° over the nose and shoulder, and at 30° at the gage. It is also contemplated that cutting elements 32 may comprise suitably mounted and exposed natural diamonds, thermally stable polycrystalline diamond compacts, cubic boron nitride compacts, or diamond grit-impregnated segments, as known in the art and as may be selected in consideration of the hardness and abrasiveness of the subterranean formation or formations to be drilled.

Also, each of blades 22 may include a gage region 25, which is configured to define the outermost radius of the drill bit 12 and, thus the radius of the wall surface of a borehole drilled thereby. Gage regions 25 comprise longitudinally upward (as the drill bit 12 is oriented during use) extensions of blades 22, extending from nose portion 20 and may have wear-resistant inserts or coatings, such as cutting elements in the form of gage trimmers of natural or synthetic diamond, hardfacing material, or both, on radially outer surfaces thereof as known in the art.

Drill bit 12 may also be provided with abrasive cutting structures 36 of another type different from the cutting elements 32. Abrasive cutting structures 36 may comprise a composite material comprising a plurality of hard particles in a matrix. The plurality of hard particles may comprise a carbide material such as tungsten (W), Ti, Mo, Nb, V, Hf, Ta, Cr, Zr, Al, and Si carbide, or a ceramic. The plurality of particles may comprise one or more of coarse, medium or fine particles comprising substantially rough, jagged edges. By way of example and not limitation, the plurality of particles may comprise sizes selected from the range of sizes including ½-inch particles to particles fitting through a screen having 30 openings per square inch (30 mesh). Particles comprising sizes in the range of ½-inch to 3/16-inch may be termed "coarse" particles, while particles comprising sizes in the range of 3/16-inch to 1/16-inch may be termed "medium" particles, and particles comprising sizes in the range of 10 mesh to 30 mesh maybe termed "fine" particles. The rough, jagged edges of the plurality of particles may be formed as a result of forming the plurality of particles by crushing the material of which the particles are formed. In some embodiments of the present invention the hard particles may comprise a plurality of crushed sintered tungsten carbide particles comprising sharp, jagged edges. The tungsten carbide particles may comprise particles in the range of ⅛ inch to 3/16 inch, particles within or proximate such a size range being termed "medium-sized" particles. The matrix material may comprise a high-strength, low-melting point alloy, such as a copper alloy. The material may be such that in use, the matrix material may wear away to constantly expose new pieces and rough edges of the hard particles, allowing the rough edges of the hard particles to more effectively engage the casing components and associated material. In some embodiments of the present invention, the copper alloy may comprise a composition of copper, zinc and nickel. By way of example and not limitation, the copper alloy may comprise approximately 48% copper, 41% zinc, and 10% nickel by weight.

A non-limiting example of a suitable material for abrasive cutting structures 36 includes a composite material manufactured under the trade name KUTRITE® by B & W Metals Co., Inc. of Houston Tex. The KUTRITE® composite material comprises crushed sintered tungsten carbide particles in a copper alloy having an ultimate tensile strength of 100,000 psi. Furthermore, KUTRITE® is supplied as composite rods and has a melting temperature of 1785° F., allowing the abrasive cutting structures 36 to be formed using oxyacetylene welding equipment to weld the cutting structure material in a desired position on the drill bit 12. The abrasive cutting structures 36 may, therefore, be formed and shaped while welding the material onto the blades 22. In some embodiments, the abrasive cutting structures 36 may be disposed directly on exterior surfaces of blades 22. In other embodiments, pockets or troughs 34 may be formed in blades 22, which may be configured to receive the abrasive cutting structures 36.

Figure 2:
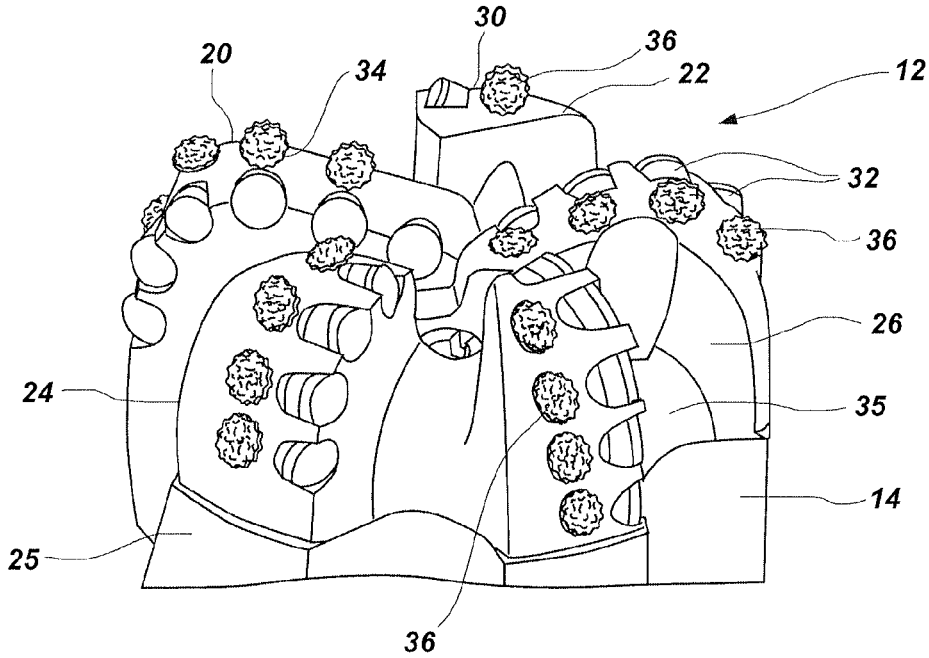
FIG. 2 shows an enlarged perspective view of a portion of the embodiment of FIG. 1.
Figure 3:
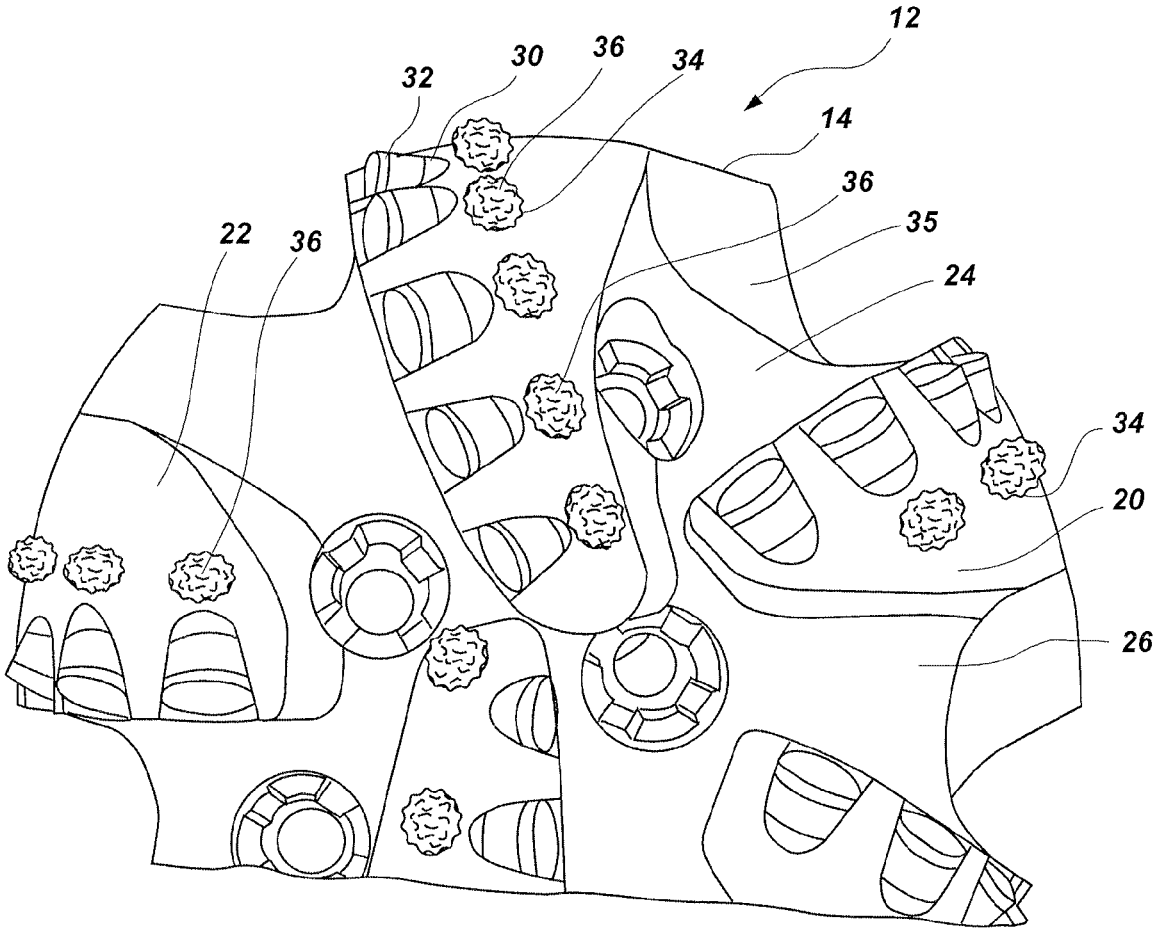
FIG. 3 shows an enlarged view of a face of the drill bit of FIG. 1.

In some embodiments, as shown in FIGS. 1-3, abrasive cutting structures 36 may comprise a protuberant lump or wear knot structure, wherein a plurality of abrasive cutting structures 36 are positioned adjacent one another along blades 22. The wear knot structures may be formed by welding the material, such as from a composite rod like that described above with relation to the KUTRITE®, in which the matrix material comprising the abrasive cutting structures is melted onto the desired location. In other words, the matrix material may be heated to its melting point and the matrix material with the hard particles is, therefore, allowed to flow onto the desired surface of the blades 22. Melting the material onto the surface of the blade 22 may require containing the material to a specific location and/or to manually shape the material into the desired shape during the application process. In some embodiments, the wear knots may comprise a pre-formed structure and may be secured to the blade 22 by brazing. Regardless whether the wear knots are pre-formed or formed directly on the blades 22, the wear knots may be formed to comprise any suitable shape, which may he selected according to the specific application. By way of example and not limitation, the wear knots may comprise a generally cylindrical shape, a post shape, or a semi-spherical shape. Some embodiments may have a substantially flattened top and others may have a pointed or chisel-shaped top as well as a variety of other configurations. The size and shape of the plurality of hard particles may form a surface that is rough and jagged, which may aid in cutting through the casing components and associated material, although, the invention is not so limited. Indeed, some embodiments may comprise surfaces that are substantially smooth and the rough and jagged hard particles may be exposed as the matrix material wears away.

Figure 4:
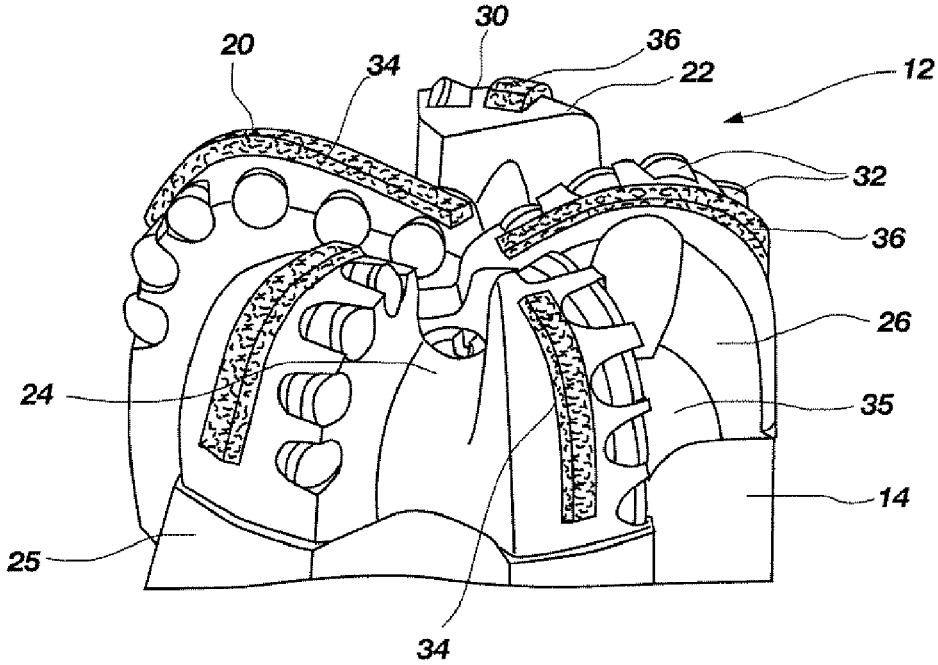
FIG. 4 shows a perspective view of a portion of another embodiment of a drill bit of the present invention.
Figure 5:
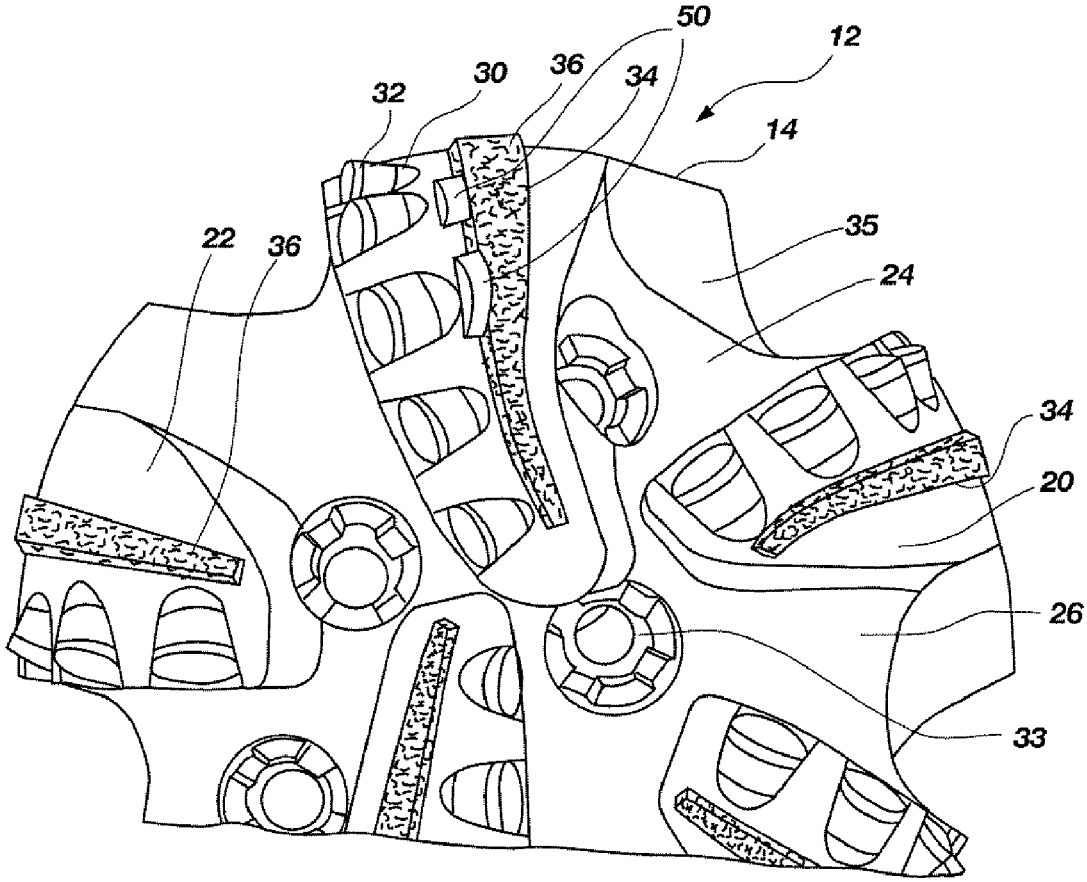
FIG. 5 shows an enlarged view of a face of a variation of the embodiment of FIG. 4.

In other embodiments, as shown in FIGS. 4 and 5, abrasive cutting structures 36 may be configured as single, elongated structures extending radially outward along blades 22. Similar to the wear knots, the elongated structures may be formed by melting the matrix material and shaping the material on the blade 22, or the elongated structures may comprise pre-formed structures, which may be secured to the blade 22 by brazing. Furthermore, the elongated structures may similarly comprise surfaces that are rough and jagged as well as surfaces that may be substantially smooth. The substantially smooth surface being worn away during use to expose the rough and jagged hard particles.

It is desirable to select or tailor the thickness or thicknesses of abrasive cutting structures 36 to provide sufficient material therein to cut through a casing bit or other structure between the interior of the casing and the surrounding formation to be drilled without incurring any substantial and potentially damaging contact of cutting elements 32 with the casing bit or other structure. In embodiments employing a plurality of abrasive cutting structures 36 configured as wear knots adjacent one another (FIGS. 1-3), the plurality of abrasive cutting structures 36 maybe positioned such that each abrasive cutting structure 36 is associated with and positioned rotationally behind a cutting element 32. The plurality of abrasive cutting structures 36 may be substantially uniform in size or the abrasive cutting structures 36 may vary in size. By way of example and not limitation, the abrasive cutting structures 36 may vary in size such that the cutting structures 36 positioned at more radially outward locations (and, thus, which traverse relatively greater distance for each rotation of drill bit 12 than those, for example, within the cone of drill bit 12) may be greater in size or at least in exposure so as to accommodate greater wear.

Similarly, in embodiments employing single, elongated structures on the blades 22, abrasive cutting structures 36 may be of substantially uniform thickness, taken in the direction of intended bit rotation, as depicted in FIG. 4, or abrasive cutting structures 36 may be of varying thickness, taken in the direction of bit rotation, as depicted in FIG. 5. By way of example and not limitation, abrasive cutting structures 36 at more radially outward locations may be thicker. In other embodiments, the abrasive cutting structures 36 may comprise a thickness to cover substantially the whole surface of the blades 22 behind the cutting elements 32.

In some embodiments, a plurality of discrete cutters 50 may be positioned proximate the cutting structures 36. Embodiments of the present invention may comprise discrete cutters 50, which rotationally "lead" the cutting structures 36 as illustrated in FIG. 5, rotationally "follow" the cutting structures 36, or which are disposed at least partially within or surrounded by the cutting structures 36. The discrete cutters 50 may comprise cutters similar to those described in U.S. Patent Publication 2007/0079995, the disclosure of which is incorporated herein in its entirety by this reference. Other suitable discrete cutters 50 may include the abrasive cutting elements 42 (FIGS. 8-10C) described in greater detail below. In some embodiments, the discrete cutters 50 may be disposed on blades 22 proximate the cutting structures 36 such that the discrete cutters 50 have a relative exposure greater than the relative exposure of cutting structures 36, such that the discrete cutters 50 come into contact with casing components before the cutting structures 36. In other embodiments, the discrete cutters 50 and the cutting structures 36 have approximately the same relative exposure. In still other embodiments, the discrete cutters 50 have a relative exposure less than the relative exposure of cutting structures 36. In embodiments having a lower relative exposure than the cutting structures 36, and in which the discrete cutters 50 are disposed within the cutting structures 36, the discrete cutters 50 may be at least partially covered by the material comprising cutting structures 36.

Also as shown in FIGS. 1-5, abrasive cutting structures 36 may extend along an area from the cone of the drill bit 12 out to the shoulder (in the area from the centerline L (FIGS. 6 and 7) to gage regions 25) to provide maximum protection for cutting elements 32, which are highly susceptible to damage when drilling casing assembly components. Cutting elements 32 and abrasive cutting structures 36 may be respectively dimensioned and configured, in combination with the respective depths and locations of pockets 30 and, when present, troughs 34, to provide abrasive cutting structures 36 with a greater relative exposure than superabrasive cutting elements 32. As used herein, the term "exposure" of a cutting element generally indicates its distance of protrusion above a portion of a drill bit, for example a blade surface or the profile thereof to which it is mounted. However, in reference specifically to the present invention, "relative exposure" is used to denote a difference in exposure between a cutting element 32 and a cutting structure 36 (as well as an abrasive cutting element 42 described below). More specifically, the term "relative exposure" may be used to denote a difference in exposure between one cutting element 32 and a cutting structure 36 (or abrasive cutting element 42) which, optionally, may be proximately located in a direction of bit rotation and along the same or similar rotational path. In the embodiments depicted in FIGS. 1-5, abrasive cutting structures 36 may generally be described as rotationally "following" superabrasive cutting elements 32 and in close rotational proximity on the same blade 22. However, abrasive cutting structures 36 may also be located to rotationally "lead" associated superabrasive cutting elements 32, to fill an area between laterally adjacent superabrasive cutting elements 32, or both.

Figure 6:
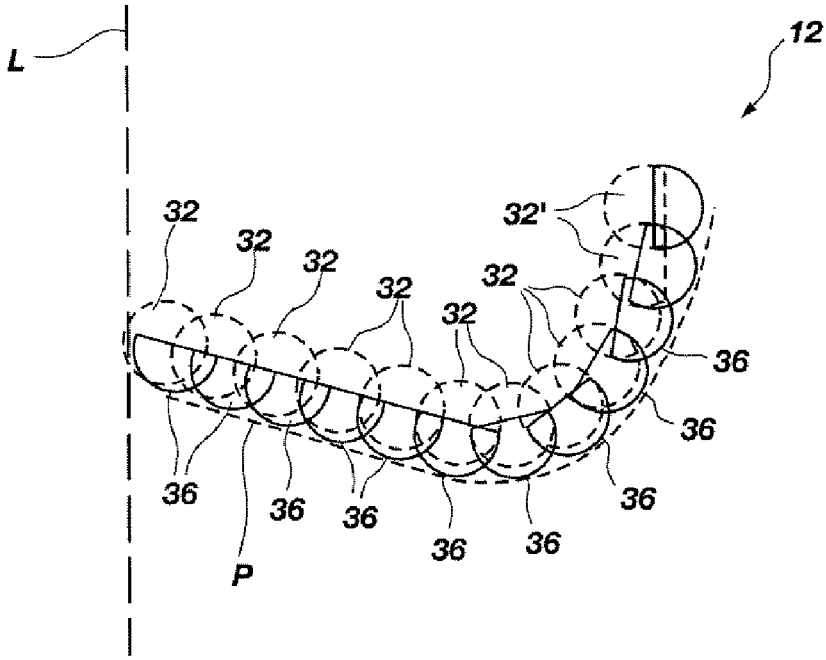
FIG. 6 shows a schematic side cross-sectional view of a cutting element placement design of a drill bit according to the embodiment of FIG. 1 showing relative exposures of cutting elements and cutting structures disposed thereon.
Figure 7:
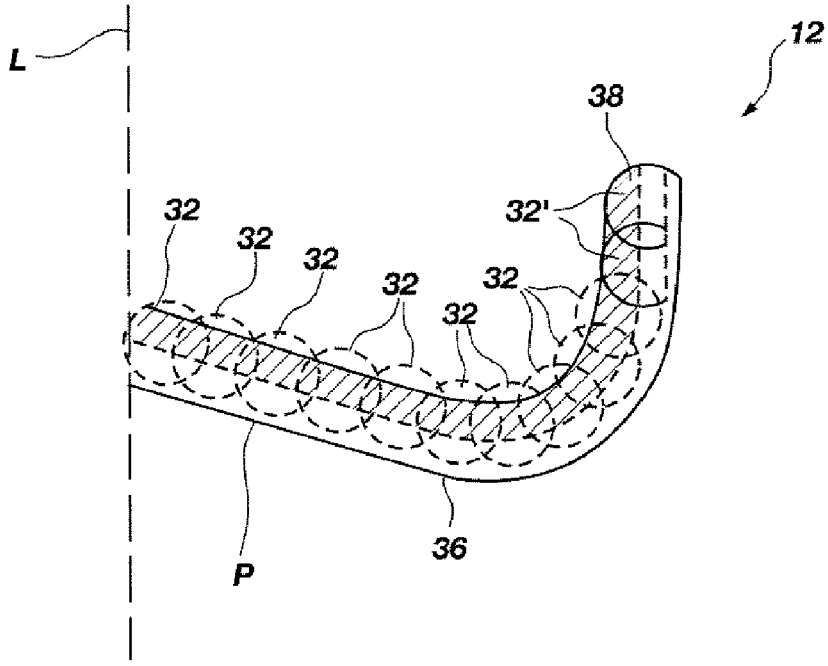
FIG. 7 shows a schematic side cross-sectional view of a cutting element placement design of a drill bit according to the embodiment of FIG. 4 showing relative exposures of cutting elements and a cutting structure disposed thereon.

By way of illustration of the foregoing, FIG. 6 shows a schematic side view of a cutting element placement design for drill bit 12 showing cutting elements 32, 32' and cutting structures 36 as disposed on a drill bit (not shown) such as an embodiment of drill bit 12 as shown in FIGS. 1-3. FIG. 7 shows a similar schematic side view showing cutting elements 32, 32' and cutting structure 36 as disposed on a drill bit (not shown) such as an embodiment of drill bit 12 as shown in FIGS. 4 and 5. Both FIGS. 6 and 7, show cutting elements 32, 32' and cutting structures 36 in relation to the longitudinal axis or centerline L and drilling profile P thereof, as if all the cutting elements 32, 32', and cutting structures 36 were rotated onto a single blade (not shown). Particularly, cutting structures 36 may be sized, configured, and positioned so as to engage and drill a first material or region, such as a casing shoe, casing bit, cementing equipment component or other downhole component. Further, the cutting structures 36 may be further configured to drill through a region of cement that surrounds a casing shoe, if it has been cemented within a well bore, as known in the art. In addition, a plurality of cutting elements 32 may be sized, configured, and positioned to drill into a subterranean formation. Also, cutting elements 32' are shown as configured with radially outwardly oriented flats and positioned to cut a gage diameter of drill bit 12, but the gage region of the cutting element placement design for drill bit 12 may also include cutting elements 32 and cutting structures 36. The present invention contemplates that the cutting structures 36 may be more exposed than the plurality of cutting elements 32 and 32'. In this way, the cutting structures 36 may be sacrificial in relation to the plurality of cutting elements 32 and 32'. Explaining further, the cutting structures 36 may be configured to initially engage and drill through materials and regions that are different from subsequent materials and regions than the plurality of cutting elements 32 and 32' is configured to engage and drill through.

Accordingly, the cutting structures 36 may comprise an abrasive material, as described above, while the plurality of cutting elements 32 and 32' may comprise PDC cutting elements. Such a configuration may facilitate drilling through a casing shoe or bit, as well as cementing equipment components within the casing on which the casing shoe or bit is disposed as well as the cement thereabout with primarily the cutting structures 36. However, upon passing into a subterranean formation, the abrasiveness of the subterranean formation material being drilled may wear away the material of cutting structures 36 to enable the plurality of PDC cutting elements 32 to engage the formation. As shown in FIGS. 1-5, one or more of the plurality of cutting elements 32 may rotationally precede the cutting structures 36, without limitation. Alternatively, one or more of the plurality of cutting elements 32 may rotationally follow the cutting structures 36.

Notably, after the material of cutting structures 36 has been worn away by the abrasiveness of the subterranean formation material being drilled, the PDC cutting elements 32 are relieved and may drill more efficiently. Further, the materials selected for the cutting structures 36 may allow the cutting structures 36 to wear away relatively quickly and thoroughly so that the PDC cutting elements 32 may engage the subterranean formation material more efficiently and without interference from the cutting structures 36.

In some embodiments a layer of sacrificial material 38 (FIG. 7) may be initially disposed on the surface of a blade 22 or in optional pocket or trough 34 and the tungsten carbide of one or more cutting structures 36 disposed thereover. Sacrificial material 38 may comprise a low-carbide or no-carbide material that maybe configured to wear away quickly upon engaging the subterranean formation material in order to more readily expose the plurality of cutting elements 32. The sacrificial material 38 may have a relative exposure less than the plurality of cutting elements 32, but the one or more cutting structures 36 disposed thereon will achieve a total relative exposure greater than that of the plurality of cutting elements 32. In other words, the sacrificial material 38 may be disposed on blades 22, and optionally in a pocket or trough 34, having an exposure less than the exposure of the plurality of cutting elements 32. The one or more cutting structures 36 may then be disposed over the sacrificial material 38, the one or more cutting structures 36 having an exposure greater than the plurality of cutting elements 32. By way of example and not limitation, a suitable exposure for sacrificial material 38 may be two-thirds or three-fourths of the exposure of the plurality of cutting elements 32.

Figure 8:
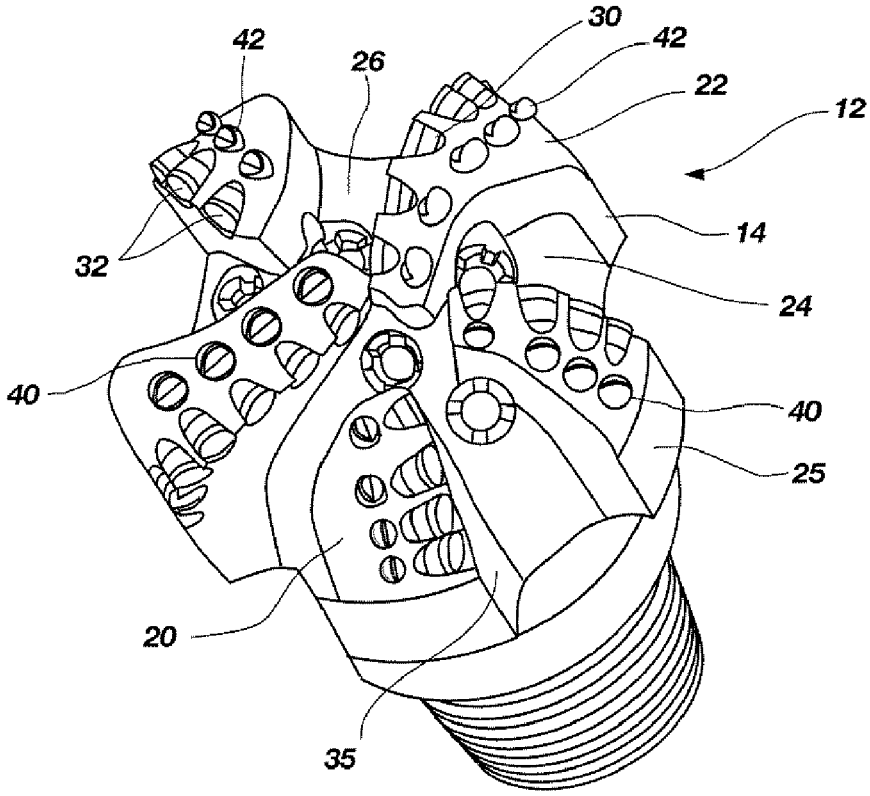
FIG. 8 shows a perspective view of another embodiment of a drill bit of the present invention.
Figure 9:
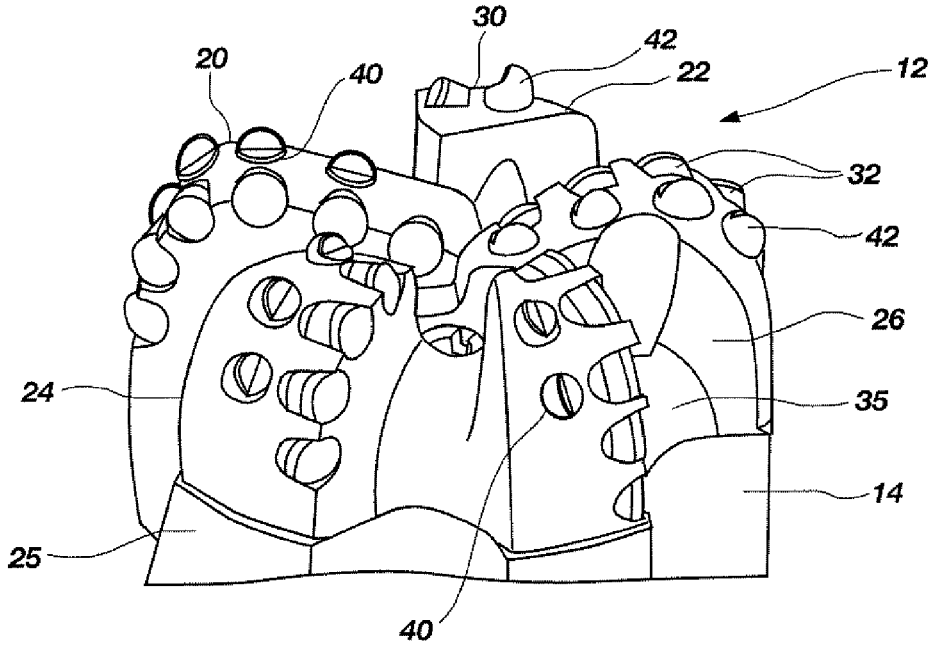
FIG. 9 shows an enlarged perspective view of a portion of the drill bit of FIG. 8.

Recently, new cutting elements configured for casing component drillout have been disclosed and claimed in U.S. Patent Publication 2007/0079995, referenced above. FIGS. 8 and 9 illustrate several variations of an additional embodiment of a drill bit 12 in the form of a fixed-cutter or so-called "drag" bit, according to the present invention. In these embodiments, drill bit 12 may be provided with, for example, pockets 40 in blades 22, which may be configured to receive abrasive cutting elements 42 of another type, different from the first type of cutting elements 32 such as, for instance, tungsten carbide cutting elements. It is also contemplated, however, that abrasive cutting elements 42 may comprise, for example, a carbide material other than tungsten (W) carbide, such as a Ti, Mo, Nb, V, Hf, Ta, Cr, Zr, Al, and Si carbide, or a ceramic. Abrasive cutting elements 42 may be secured within pockets 40 by welding, brazing or as otherwise known in the art. Abrasive cutting elements 42 may be of substantially uniform thickness, taken in the direction of intended bit rotation. In other embodiments, and similar to cutting structures 36 above, abrasive cutting elements 42 may be of varying thickness, taken in the direction of bit rotation, wherein abrasive cutting elements 42 at more radially outwardly locations (and, thus, which traverse relatively greater distance for each rotation of drill bit 12 than those, for example, within the cone of dill bit 12) may be thicker to ensure adequate material thereof will remain for cutting casing components and cement until they are to be worn away by contact with formation material after the casing components and cement are penetrated. It is desirable to select or tailor the thickness or thicknesses of abrasive cutting elements 42 to provide sufficient material therein to cut through a casing bit or other structure between the interior of the casing and the surrounding formation to be drilled, without incurring any substantial and potentially damaging contact of superabrasive cutting elements 32 with the casing bit or other structure.

Also as shown in FIGS. 8 and 9, like the abrasive cutting structure 36 described above, abrasive cutting elements 42 may be placed on the blades 22 of a drill bit 12 from the cone of the drill bit 12 out to the shoulder to provide maximum protection for cutting elements 32. Abrasive cutting elements 42 may be back raked, by way of non-limiting example, at an angle of 5°. Broadly, cutting elements 32 on face 26, which may be defined as surfaces up to 90° profile angles, or angles with respect to centerline L, are desirably protected. Abrasive cutting elements 42 may also be placed selectively along the profile of the face 26 to provide enhanced protection to certain areas of the face 26 and for cutting elements 32 thereon, as well as for cutting elements 32', if present on the gage regions 25.

Figure 10A:
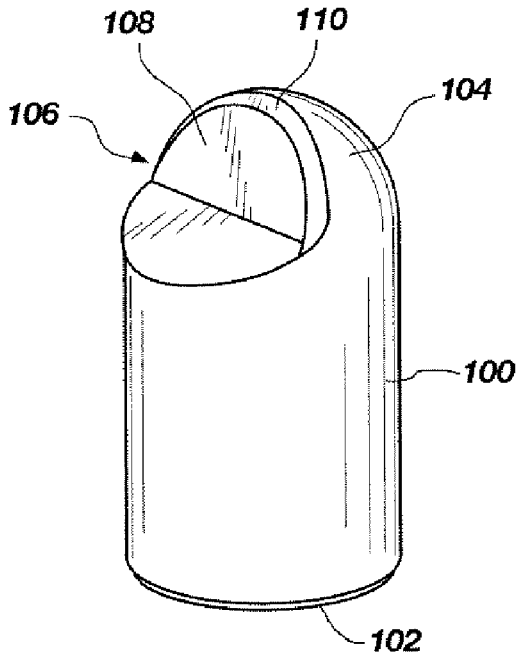
FIG. 10A is a perspective view of one embodiment of a cutting element suitable for drilling through a casing bit and, if present, cementing equipment components within a casing above the casing bit.
Figure 10B:
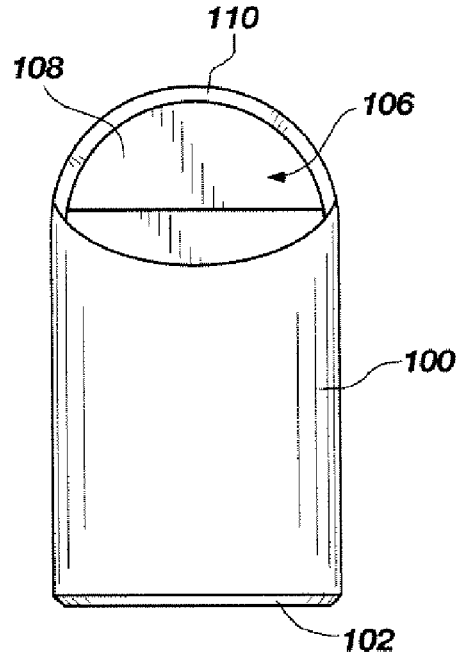
FIG. 10B is a front elevational view of the cutting element of FIG. 10A.
Figure 10C:
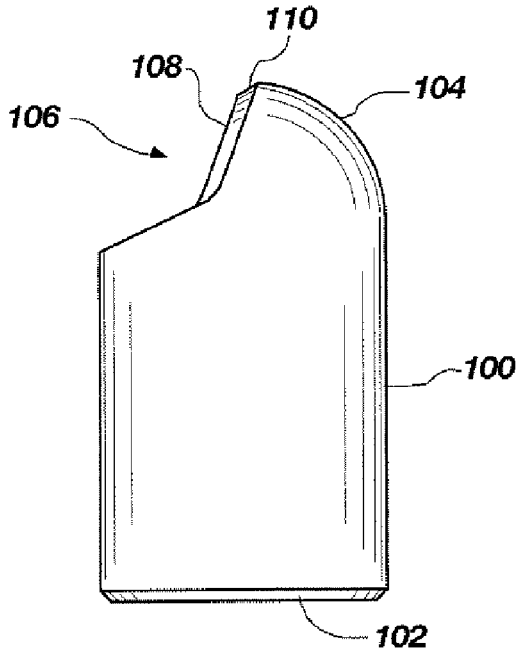
FIG. 10C is a side elevational view of the cutting element of FIG. 10A.

FIGS. 10A-10C depict one example of a suitable configuration for abrasive cutting elements 42, including a cylindrical body 100, which may also be characterized as being of a "post" shape, of tungsten carbide or other suitable material for cutting casing or casing components, including a bottom 102, which will rest on the bottom of pocket 40. Cylindrical body 100 may provide increased strength against normal and rotational forces as well as increased ease with which a cutting element 42 may be replaced. Although body 100 is configured as a cylinder in FIGS. 10A-10C, and thus exhibits a circular cross-section, one of ordinary skill in the art will recognize that other suitable configurations may be employed for body 100, including those exhibiting a cross section that is, by way of example and not limitation, substantially ovoid, rectangular, or square.

In a non-limiting example, the cylindrical body 100 extends to a top portion 104 including a notched area 106 positioned in a rotationally leading portion thereof. The top portion 104 is illustrated as semi-spherical, although many other configurations are possible and will be apparent to one of ordinary skill in the art. Notched area 106 comprises a substantially flat cutting face 108 extending to a chamfer 110 that leads to an uppermost extent of top portion 104. Cutting face 108 may be formed at, for example, a forward rake, a neutral (about 0°) rake or a back rake of up to about 25°, for effective cutting of a casing shoe, reamer shoe, casing bit, cementing equipment components, and cement, although a specific range of back rakes for cutting elements 42 and cutting faces 108 is not limiting of the present invention. Cutting face 108 is of a configuration relating to the shape of top portion 104. For example, a semi-spherical top portion 104 provides a semicircular cutting face 108, as illustrated. However, other cutting face and top portion configurations are possible. By way of a non-limiting example, the top portion 104 may be configured in a manner to provide a cutting face 108 shaped in any of ovoid, rectangular, tombstone, triangular etc.

Any of the foregoing configurations for an abrasive cutting element 42 may be implemented in the form of a cutting element having a tough or ductile core covered on one or more exterior surfaces with a wear-resistant coating such as tungsten carbide or titanium nitride.

In some embodiments of the present invention, a drill bit, such as drill bit 12, may employ a combination of abrasive cutting structures 36 and abrasive cutting elements 42. In such embodiments, the abrasive cutting structures 36 and abrasive cutting elements 42 may have a similar exposure. In other embodiments, one of the abrasive cutting structures 36 and abrasive cutting elements 42 may have a greater relative exposure than the other. For example, a greater exposure for some of cutting structures 36 and/or abrasive cutting elements 42 may be selected to ensure preferential initial engagement of same with portions of a casing-associated component or casing sidewall.

While examples of specific cutting element configurations for cutting casing-associated components and cement, on the one hand, and subterranean formation material on the other hand, have been depicted and described, the invention is not so limited. The cutting element configurations as disclosed herein are merely examples of designs, which the inventors believe are suitable. Other cutting element designs for cutting casing-associated components may employ, for example, additional chamfers or cutting edges, or no chamfer or cutting edge at all may be employed. Examples of some suitable non-limiting embodiments of chamfers or cutting edges are described in U.S. Patent Publication 2007/0079995, referenced above. Likewise, superabrasive cutting elements design and manufacture is a highly developed, sophisticated technology, and it is well-known in the art to match superabrasive cutting element designs and materials to a specific formation or formations intended to be drilled.

Figure 11:
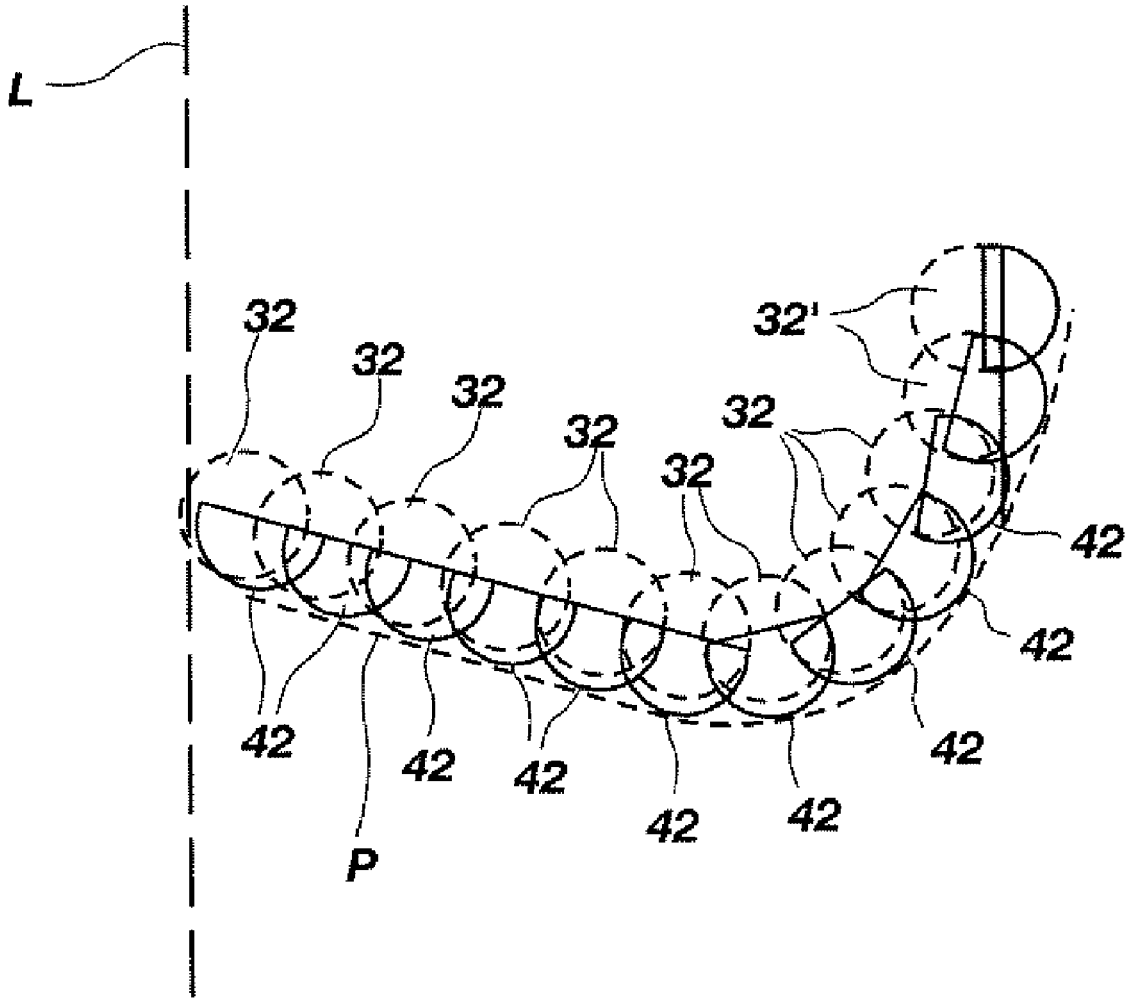
FIG. 11 shows a schematic side cross-sectional view of a cutting element placement configuration of the drill bit of FIG. 8 showing relative exposures of first and second cutting element structures disposed thereon.

FIG. 11 shows a schematic side view of a cutting element placement design similar to FIGS. 6 and 7 showing cutting elements 32, 32' and 42. Particularly, a plurality of abrasive cutting elements 42 may be sized, configured, and positioned so as to engage and drill downhole components, such as a casing shoe, casing bit, cementing equipment component, cement or other downhole components. In addition, a plurality of cutting elements 32 may be sized, configured, and positioned to drill into a subterranean formation. Also, cutting elements 32' are shown as configured with radially outwardly oriented flats and positioned to cut a gage diameter of drill bit 12, but the gage region of the cutting element placement design for drill bit 12 may also include cutting elements 32 and abrasive cutting elements 42. Embodiments of the present invention contemplate that the plurality of abrasive cutting elements 42 may be more exposed than the plurality of cutting elements 32. In this way, the one plurality of cutting elements 42 may be sacrificial in relation to the another plurality of cutting elements 32, as described above with relation to abrasive cutting structures 36 and cutting elements 32 in FIG. 4. Therefore, the plurality of abrasive cutting elements 42 may be configured to initially engage and drill through materials and regions that are different from subsequent material and regions that the plurality of cutting elements 32 are configured to engage and drill through.

Accordingly, and similar to that described above with relation to FIGS. 1-5, the plurality of abrasive cutting elements 42 may be configured differently than the plurality of cutting elements 32. Particularly, and as noted above, the plurality of abrasive cutting elements 42 may be configured to comprise tungsten carbide cutting elements, while the plurality of cutting elements 32 may comprise PDC cutting elements. Such a configuration may facilitate drilling through a casing shoe or bit, as well as cementing equipment components within the casing on which the casing shoe or bit is disposed as well as the cement thereabout with primarily the plurality of abrasive cutting elements 42. However, upon passing into a subterranean formation, the abrasiveness of the subterranean formation material being drilled may wear away the tungsten carbide of the abrasive cutting elements 42, and the plurality of PDC cutting elements 32 may engage the formation. As shown in FIGS. 8 and 9, one or more of the plurality of cutting elements 32 may rotationally precede one or more of the one plurality of abrasive cutting elements 42, without limitation. Alternatively, one or more of the plurality of cutting elements 32 may rotationally follow one or more of the one plurality of abrasive cutting elements 42, without limitation.

Notably, after the abrasive cutting elements 42 have been worn away by the abrasiveness of the subterranean formation material being drilled, the PDC cutting elements 32 are relieved and may drill more efficiently. Further, it is believed that the worn abrasive cutting elements 42 may function as backups for the PDC cutting elements 32, riding generally in the paths cut in the formation material by the PDC cutting elements 32 and enhancing stability of the drill bit 12, enabling increased life of these cutting elements and consequent enhanced durability and drilling efficiency of drill bit 12.

While certain embodiments have been described and shown in the accompanying drawings, such embodiments are merely illustrative and not restrictive of the scope of the invention, and this invention is not limited to the specific constructions and arrangements shown and described, since various other additions and modifications to, and deletions from, the described embodiments will be apparent to one of ordinary skill in the art. Thus, the scope of the invention is only limited by the literal language, and legal equivalents of the claims, which follow.

What is claimed is:

1. An earth-boring tool, comprising:

a body having a face at a leading end thereof;

a plurality of cutting elements disposed on the body; and at least one elongated abrasive cutting structure disposed over the body and extending laterally outward, the at least one elongated abrasive cutting structure positioned proximate to and rotationally trailing at least two cutting elements of the plurality of cutting elements and having a greater relative exposure than the at least two cutting elements of the plurality of cutting elements.

2. The earth-boring tool of claim 1, wherein the at least one elongated abrasive cutting structure comprises a composite material comprising a plurality of particles in a matrix material, the plurality of particles comprising at least one of a ceramic and a carbide material.

3. The earth-boring tool of claim 2, wherein the carbide material is selected from the group consisting of W, Ti, Mo, Nb, V, Hf, Ta, Cr, Zr, Al, and Si.

4. The earth-boring tool of claim 3, wherein the plurality of particles comprises sintered tungsten carbide.

5. The earth-boring tool of claim 2, wherein the plurality of particles comprises at least one of coarse, medium, and fine particles.

6. The earth-boring tool of claim 2, wherein a size of the plurality of particles is selected from a range of sizes comprising about one-half inch to 30 mesh.

7. The earth-boring tool of claim 6, wherein the particles of the plurality of particles are between about 1/8 inch and 3/16 inch in size.

8. The earth-boring tool of claim 2, wherein the matrix material comprises an alloy comprising copper, zinc and nickel.

9. The earth-boring tool of claim 8, wherein the matrix material comprises an alloy comprising 48% copper, 41% zinc, and 10% nickel by composition.

10. The earth-boring tool of claim 1, wherein the body comprises at least one trough therein, and at least a portion of the at least one elongated abrasive cutting structure is disposed in the at least one trough.

11. The earth-boring tool of claim 1, further comprising a sacrificial material disposed over the body, wherein the at least one elongated abrasive cutting structure is disposed over the sacrificial material.

12. The earth-boring tool of claim 1, wherein a portion of the at least one elongated abrasive cutting structure at a radially outward location comprises a thickness taken in a direction of intended tool rotation greater than a thickness taken in the direction of intended tool rotation of another portion of the at least one elongated abrasive cutting structure at a radially inward location.

13. The earth-boring tool of claim 1, further comprising a plurality of discrete cutters disposed proximate the at least one elongated abrasive cutting structure.

14. The earth-boring tool of claim 1, further comprising a plurality of generally radially extending blades on the face, wherein the plurality of cutting elements are disposed on the plurality of blades, and wherein the at least one elongated abrasive cutting structure is disposed along at least one of the plurality of blades.

15. The earth-boring tool of claim 1, wherein the at least one elongated abrasive cutting structure extends laterally outward from a cone of the body to a shoulder and rotationally trails each cutting element of the plurality of cutting elements disposed on the body.

16. A method of forming an earth-boring tool, comprising:

forming a bit body comprising a face at a leading end thereof;

disposing a plurality of cutting elements on the bit body; and disposing at least one elongated abrasive cutting structure on the bit body proximate to and rotationally trailing at least two cutting elements of the plurality of cutting elements and having a greater relative exposure than at least one of the plurality of cutting elements, the at least one elongated abrasive cutting structure comprising a composite material comprising a plurality of hard particles with substantially rough surfaces in a matrix material.

17. The method of claim 16, wherein disposing at least one elongated abrasive cutting structure comprises brazing at least one pre-formed abrasive cutting structure on the bit body.

18. The method of claim 16, wherein disposing at least one elongated abrasive cutting structure comprises forming the at least one elongated abrasive cutting structure on the bit body.

19. The method of claim 18, wherein forming the at least one elongated abrasive cutting structure on the bit body comprises welding the composite material onto a desired location of the bit body.

20. The method of claim 16, wherein disposing at least one elongated abrasive cutting structure on the bit body comprises disposing the at least one elongated abrasive cutting structure in a trough formed in the bit body.

21. The method of claim 16, wherein disposing at least one elongated abrasive cutting structure on the bit body comprises:

disposing a sacrificial material on the bit body; and disposing the at least one elongated abrasive cutting structure over the sacrificial material.

22. The method of claim 16, wherein disposing at least one elongated abrasive cutting structure comprises disposing the at least one elongated abrasive cutting structure to extend laterally outward along each cutting element of a plurality of cutting elements disposed on one blade formed on the bit body.

23. A method of drilling with an earth-boring tool, comprising:

engaging and drilling a first material using at least one elongated abrasive cutting structure positioned proximate to and rotationally trailing at least two cutting elements of a plurality of cutting elements disposed on the earth-boring tool and comprising a composite material comprising a plurality of hard particles exhibiting a substantially rough surface in a matrix material; and subsequently engaging and drilling a subterranean formation adjacent the first material using the plurality of cutting elements.

24. The method of claim 23, wherein engaging and drilling the first material comprises engaging and drilling at least one of a casing shoe, a casing bit, a cementing equipment component, and cement.

25. The method of claim 23, wherein engaging and drilling the first material using at least one elongated abrasive cutting structure comprises engaging and drilling the first material using the at least one elongated abrasive cutting structure disposed in at least one trough in a body of an earth-boring tool.

26. The method of claim 23, wherein engaging and drilling the first material using at least one elongated abrasive cutting structure comprises engaging and drilling the first material using the at least one elongated abrasive cutting structure disposed over a sacrificial material.

27. The method of claim 23, wherein engaging and drilling the first material using at least one elongated abrasive cutting structure comprises engaging and drilling the first material using the at least one elongated abrasive cutting structure comprising a composite material comprising a plurality of at least one of coarse, medium, and fine hard particles.

* * * * *